US009005046B2

(12) United States Patent
Thomas et al.

(10) Patent No.: US 9,005,046 B2
(45) Date of Patent: Apr. 14, 2015

(54) GOLF CLUB HEAD OR OTHER BALL STRIKING DEVICE WITH WEAR INDICATOR

(75) Inventors: James S. Thomas, Ft. Worth, TX (US); Chris Savage, Beaverton, OR (US); Don Rahrig, Mansfield, TX (US)

(73) Assignee: Nike, Inc., Beaverton, OR (US)

( * ) Notice: Subject to any disclaimer, the term of this patent is extended or adjusted under 35 U.S.C. 154(b) by 451 days.

(21) Appl. No.: 13/252,770

(22) Filed: Oct. 4, 2011

(65) Prior Publication Data

US 2013/0085009 A1 Apr. 4, 2013

(51) Int. Cl.
*A63B 69/36* (2006.01)
*A63B 53/04* (2006.01)

(52) U.S. Cl.
CPC ..... *A63B 53/04* (2013.01); *A63B 2053/0445* (2013.01); *A63B 53/0466* (2013.01); *A63B 53/047* (2013.01)

(58) Field of Classification Search
USPC ..... 473/324–350, 287–292, 226, 231, 238
See application file for complete search history.

(56) References Cited

U.S. PATENT DOCUMENTS

| | | | | |
|---|---|---|---|---|
| 2,034,936 | A * | 3/1936 | Barnhart | 473/329 |
| 3,869,126 | A * | 3/1975 | Thompson | 473/331 |
| 4,753,440 | A * | 6/1988 | Chorne | 473/242 |
| 4,858,332 | A | 8/1989 | Thomas | |
| 5,437,088 | A * | 8/1995 | Igarashi | 29/527.6 |
| 5,643,099 | A * | 7/1997 | Solheim | 473/238 |
| 5,688,186 | A * | 11/1997 | Michaels et al. | 473/290 |
| 6,398,665 | B1 * | 6/2002 | Antonious | 473/330 |
| 6,443,856 | B1 * | 9/2002 | Galloway et al. | 473/330 |
| 7,004,848 | B2 | 2/2006 | Konow | |
| 7,594,862 | B2 * | 9/2009 | Gilbert | 473/330 |
| 7,594,863 | B2 * | 9/2009 | Ban | 473/331 |
| 8,021,245 | B2 * | 9/2011 | Beach | 473/331 |
| 8,506,420 | B2 * | 8/2013 | Hocknell et al. | 473/331 |
| 2004/0192465 | A1 * | 9/2004 | Erb et al. | 473/331 |
| 2008/0207351 | A1 * | 8/2008 | Wallans et al. | 473/331 |
| 2009/0305812 | A1 | 12/2009 | Nakamura | |
| 2009/0313806 | A1 | 12/2009 | Gilbert | |
| 2011/0070963 | A1 | 3/2011 | Fedorochko et al. | |

OTHER PUBLICATIONS

ISR & WO mailed Dec. 18, 2012 from PCT Application No. PCT/US2012/057437.

* cited by examiner

*Primary Examiner* — Sebastiano Passaniti
(74) *Attorney, Agent, or Firm* — Banner & Witcoff, Ltd.

(57) ABSTRACT

A ball striking device, such as a golf club, includes a head with a face having the ball striking surface located at a front of the head and a plurality of parallel face grooves extending laterally across at least a portion of the ball striking surface, a body connected to the face and extending rearward from the face, and an indicator on the ball striking surface of the face. The indicator is located in an area between the face grooves and proximate a lateral center of the ball striking surface, and includes at least one indent in the ball striking surface. The indent has a depth that is substantially less than a depth of any of the face grooves. Methods associated with such ball striking devices are also provided.

16 Claims, 14 Drawing Sheets

FIG. 2
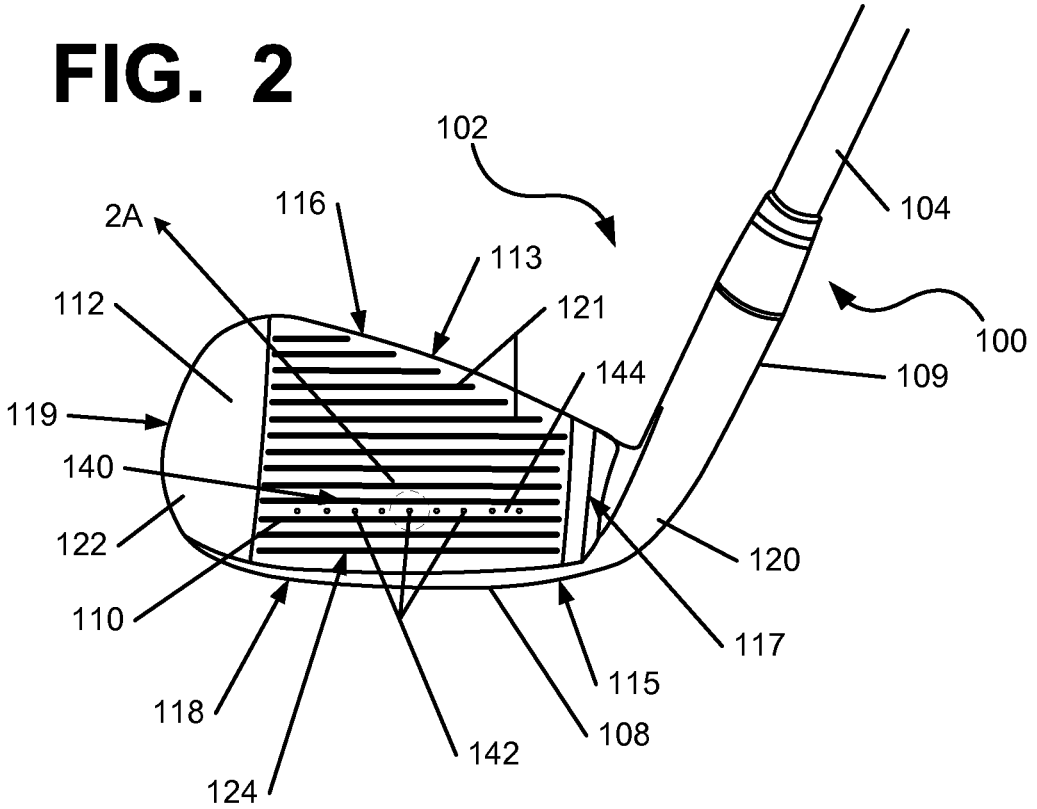
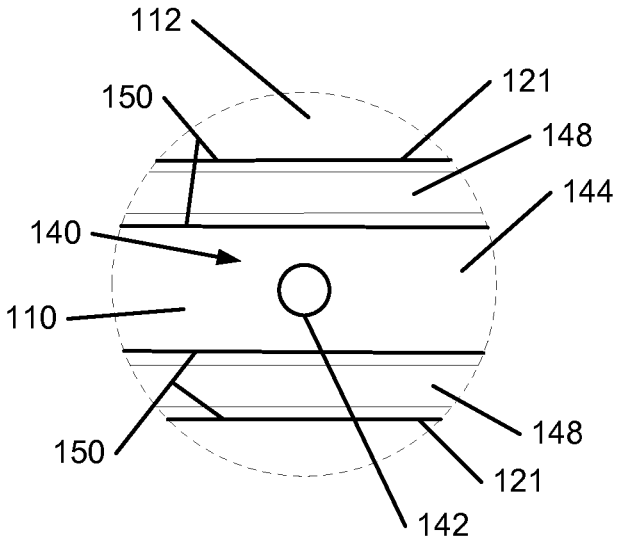
FIG. 2A

FIG. 11
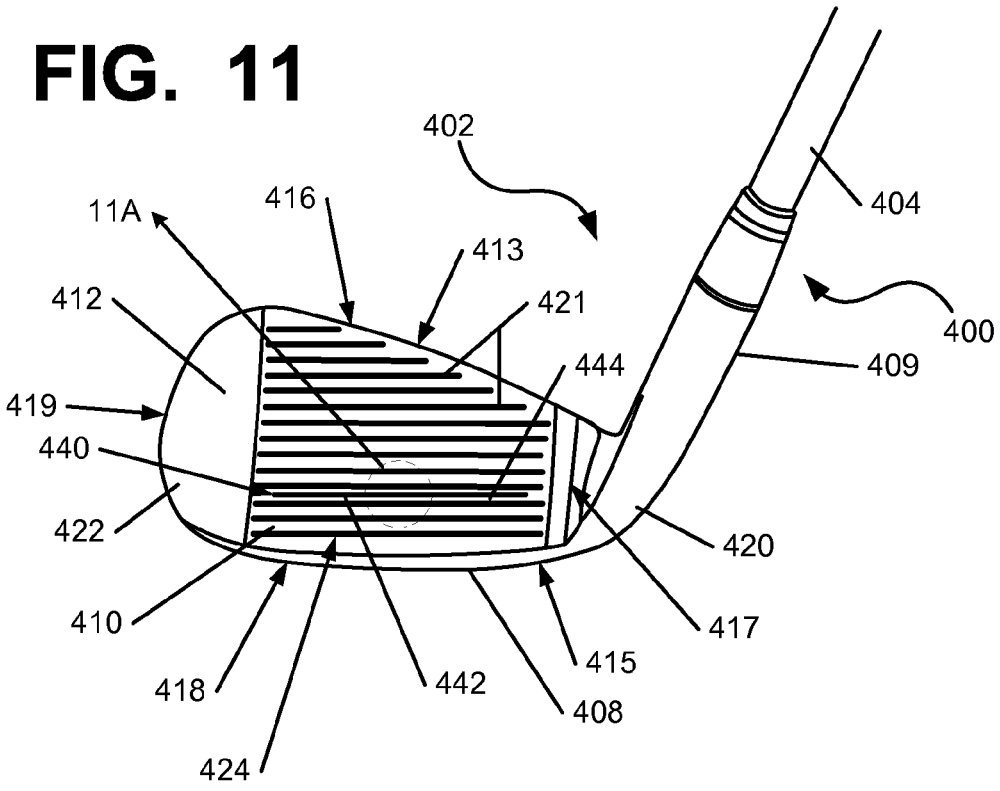
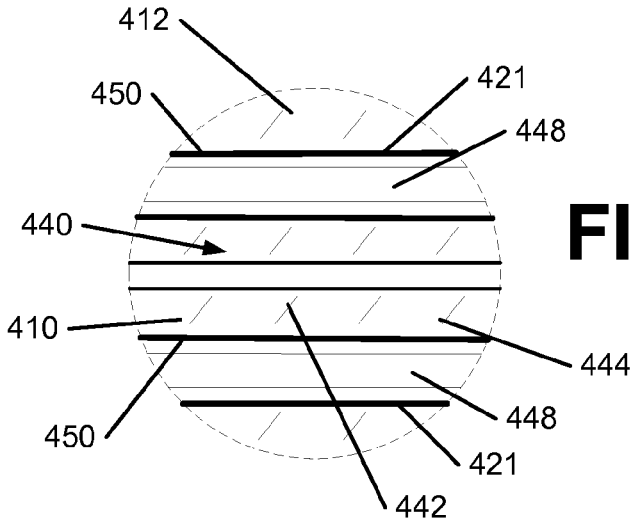
FIG. 11A

FIG. 17
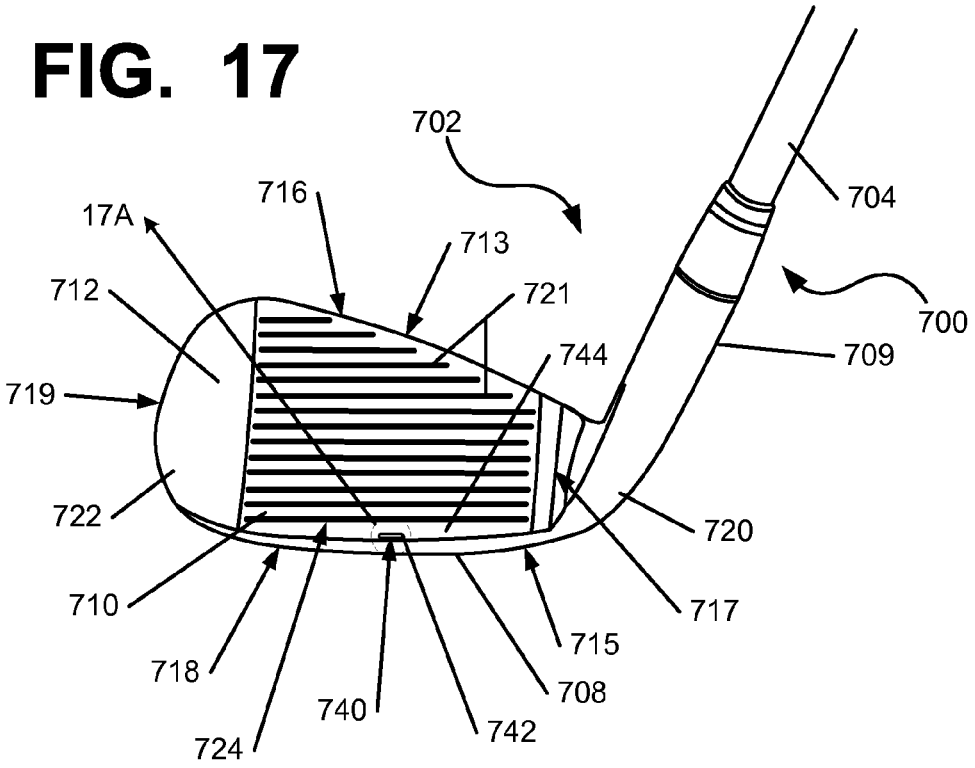
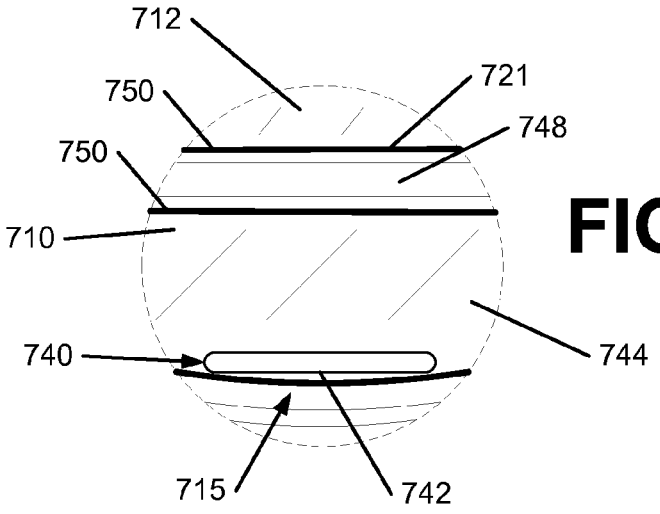
FIG. 17A

GOLF CLUB HEAD OR OTHER BALL STRIKING DEVICE WITH WEAR INDICATOR

TECHNICAL FIELD

The invention relates generally to ball striking devices, such as golf clubs and heads. Certain aspects of this invention relate to golf clubs and golf club heads having at least one indicator that indicates whether the head may be suitable for replacement due to wear on the face of the head.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. The energy or velocity transferred to the ball by a golf club also may be related, at least in part, to the "coefficient of restitution" (or "COR") of the club face at the point of contact. The maximum COR for golf club heads is currently limited by the USGA at 0.83. Generally, a club head will have an area of highest response or highest COR relative to other areas of the face, which imparts the greatest energy and velocity to the ball, and this area is typically positioned at the desired ball contact location, usually at the center of the face.

The distance and direction of ball flight can also be significantly affected by the spin imparted to the ball by the impact with the club head. While the ball is in the air, aerodynamic forces caused by the speed and direction of ball spin can cause the trajectory of the ball to be higher or lower, or to curve, and create "pulls," "pushes," "draws," "fades," "hooks," "slices," etc. Additionally, the spin of the ball can change the behavior of the ball as it rolls and bounces after impact with the ground. For example, a high degree of backspin can cause the ball to slow, stop, or even roll backward upon impact, and conversely, topspin or lesser degrees of backspin will cause the ball to travel a greater distance after impact with the ground. Various speeds and directions of spin on the ball can be a product of many factors, including the point of impact, the direction of the club head upon impact, the degree of twisting of the club head upon impact, and the location of the center of gravity of the club head. The interaction between the ball and the club face at the point of impact, including traction, friction, etc., can also have a significant influence on the degree of spin imparted to the ball upon impact.

The cover of a golf ball is typically made of a polymer such as an ionomer or urethane, among other materials. The cover material comes into physical contact with the club face during a golf shot. In order to generate desired backspin or other spin on the ball, a shearing force must be exerted on the ball by the face of the club. Many club heads have grooves on the ball striking face of the club that can aid this interaction by creating areas into which the ball cover can deform during impact, increasing the traction between the ball and the face, to more effectively transmit torque to the ball. The configurations of these grooves, including the widths, depths, shapes, directions, cross-sectional or profile shapes, and distribution of the grooves, among other characteristics, can influence the amount and direction of spin imparted to the ball upon impact. USGA rules may limit the configuration of face grooves, such as by limiting the width, depth, spacing, area, and/or the sharpness (radius) of the edges of the grooves, which can limit the amount of spin that can be imparted to the ball. For example, recent changes to the USGA rules currently require that the "effective radius" of the edges of each groove is not less than 0.010" and not greater than 0.020". This is determined by using the "two circles" method as described in the USGA rules, "Determination of Groove Conformance, Impact Area Markings (App II, 5c) Measurement Procedure," August 2008.

In some circumstances, it may be desirable to impart as little spin as possible to the ball, such as to achieve a straighter and longer ball flight with lower or more boring trajectory and greater rolling distance. For example, many driver-type clubs are designed to impart less spin to the ball upon impact. In other circumstances, it may be desirable to impart a high degree of backspin on the ball, to achieve a higher trajectory and a minimal amount of rolling, or even to draw the ball backward after impacting the ground. For example, many iron-type clubs, hybrid clubs, and fairway wood clubs are designed to impart a greater amount of spin to the ball upon impact. Further, a golfer may wish to have the ability to impart hooking or slicing spin on a ball, such as by altering the form and/or mechanics of the golfer's swing. The grooves in the ball striking face of the golf club head can assist in achieving some or all of these performance characteristics. Accordingly, club head features that can assist in consistently achieving maximum spin on the ball can be advantageous.

The grooves in the face of a golf club head are typically formed in the material of the face through a process such as cutting, machining, forging, molding, etc. Since the face is typically made from a material that has some degree of resilience and flexibility and is not excessively hard, such as a metal, the edges defining the grooves can be susceptible to wear after repeated use. Ground detritus, rocks, sand, gravel, and other hard materials that contact the face in the course of play can become sandwiched between the ball and the face during impact, causing the club face and the grooves in the face to become worn, such as by abrasion, including wearing away of the edges of the grooves, as well as chipping, deformation, gouging the face, or otherwise deteriorating the club face. As the grooves become worn, the ability of the golfer to effectively control the ball flight trajectory and roll of the golf ball, through controlling the amount and axis of spin on the ball, can be compromised. This can be more problematic when the edges of the grooves are less sharp initially, such as due to USGA regulations. However, measuring or detecting wear on the club face and the grooves can be difficult outside of a laboratory or service center. Accordingly, club head features that can facilitate detection of excessive wear on the face and/or the grooves can enable the user to replace the club head before performance is adversely affected. This can be of particular importance to professional golfers, who depend on consistently and reliably producing the desired spin on the ball to achieve their best performance, but can also be useful to amateur and recreational golfers.

Wear on a club head, such as a wood-type club head, can also cause failure of the ball striking face through rupture upon contact with the ball in play. Generally, a club face will become weakened through removal and/or deformation of material on the face prior to rupture. Failure of the face can be troublesome, as replacement of a driver or other wood-type club is not often feasible in the middle of playing a round. As such, failure during a tournament or other competition can be disastrous. Thus, club head features that can facilitate detection of excessive wear on the face enable the user to replace the club head before rupture or other failure occurs.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face and extending rearward from the face, and an indicator on the ball striking surface of the face. The face has the ball striking surface located at a front of the head and a plurality of parallel face grooves extending laterally across at least a portion of the ball striking surface. The indicator is located in an area between the face grooves and proximate a lateral center of the ball striking surface, and includes at least one indent in the ball striking surface. The indent has a depth that is substantially less than a depth of any of the face grooves.

According to one aspect, the depth of the indent is up to 180 μ-inches, and may be less than 2% of the depth of a deepest of the face grooves or less than 1% of the depth of a deepest of the face grooves.

According to another aspect, the indicator includes a plurality of indents in the ball striking surface, each indent having a depth that is substantially less than a depth of any of the face grooves. In one embodiment, the plurality of indents are arranged along a straight line and are all located between a first face groove and a second face groove of the plurality of face grooves. In one embodiment, each of the indents is circular in shape.

Additional aspects of the invention relate to a method used in conjunction with a head for a ball striking device that is provided, the head including a face having a ball striking surface located at a front of the head and a body connected to the face and extending rearward from the face. At least one indent is formed on the ball striking surface of the face, located proximate a lateral center of the ball striking surface.

According to one aspect, the indent may be created by laser etching on the ball striking surface, a machining or milling technique, a stamping technique, a chemical etching technique, or other such technique.

According to another aspect, a plurality of indents are formed on the ball striking surface of the face, located proximate the lateral center of the ball striking surface, such that the plurality of indents are formed along a straight line.

According to a further aspect, the head is an iron-type golf club head, and the face has a plurality of parallel face grooves extending laterally across at least a portion of the ball striking surface. The indent is located in an area between the face grooves, and the indent has a depth that is substantially less than a depth of any of the face grooves. In one embodiment, the depth of the indent is up to 180 μ-inches, and may be less than 2% of the depth of a deepest of the face grooves or less than 1% of the depth of a deepest of the face grooves.

According to yet another aspect, the head is a wood-type golf club head, and the indent is configured such that material worn away due to wearing on the ball striking surface will reach the approximate depth of the indent before the face ruptures due to pressure resulting from impact of a golf ball upon the face during normal use.

Further aspects of the invention relate to a ball striking device, such as an iron-type golf club head, that includes a face having a ball striking surface located at a front of the head, with the face having a plurality of parallel face grooves extending laterally across at least a portion of the ball striking surface, a body connected to the face and extending rearward from the face, and an indicator on the ball striking surface of the face. The indicator is located below a lowermost of the face grooves, proximate a lateral center of the ball striking surface, and proximate a lower edge of the face. The indicator includes an indent in the ball striking surface, and the indent has a depth that is substantially less than a depth of any of the face grooves.

According to one aspect, the depth of the indent may be up to 180 μ-inches, up to 100 μ-inches, or up to 500 μ-inches in various embodiments. Additionally, the depth of the indent may be less than 2% of the depth of the deepest of the face grooves, or less than 1% of the depth of the deepest of the face grooves, in various embodiments.

According to another aspect, the indent may be created by laser etching on the ball striking surface.

According to a further aspect, the indent may be located on a curved portion of the head, at a juncture between the face and the body proximate the lower edge of the face.

Still further aspects of the invention relate to a method that includes supplying to a user a ball striking device having a ball striking head that includes a face having a ball striking surface located at a front of the head, a body connected to the face and extending rearward from the face, and an indicator located on the ball striking surface of the face. The indicator includes an indent located proximate a lateral center of the ball striking surface. The ball striking device is received from the user after a period of use by the user, and the indicator is examined to determine whether wearing of the ball striking surface during use has caused sufficient material to wear away from the ball striking surface such that the depth of the indent has been reached and the indicator is no longer visible. If the indicator is no longer visible, the user is supplied with a second ball striking device to replace the ball striking device if the indicator is no longer visible.

According to one aspect, the ball striking device is a golf club and is supplied to the user as a part of a set of golf clubs, and the second ball striking device replaces the original device in the set of golf clubs.

According to another aspect, the indicator of the head as supplied includes a plurality of indents in the ball striking surface. In this configuration, the second ball striking device is supplied to replace the ball striking device if at least one of the indicators is no longer visible due to wear on the ball striking surface.

According to a further aspect, the head is an iron-type golf club head, and the face has a plurality of parallel face grooves extending laterally across at least a portion of the ball striking surface. The indent is located in an area between the face grooves, and the indent in the head as supplied has a depth that is substantially less than a depth of any of the face grooves.

According to yet another aspect, the head is a wood-type golf club head, and the indent is configured such that the depth of the indent is reached and the indent is no longer visible due to wearing away of material from the ball striking surface before the face ruptures due to pressure resulting from impact of a golf ball upon the face during normal use.

Other aspects of the invention relate to golf clubs that include a golf club head as described above and a shaft connected to the head, or a set of golf clubs including at least one golf club having a head as described above.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 2 is a front view of an illustrative embodiment of a head of the ball striking device of FIG. 1;

FIG. 2A is a magnified view of a portion of the head of FIG. 2, identified by reference 2A in FIG. 2;

FIG. 11 is a front view of a fourth illustrative embodiment of an iron-type head suitable for use with the ball striking device of FIG. 1;

FIG. 11A is a magnified view of a portion of the head of FIG. 11, identified by reference 11A in FIG. 11;

FIG. 17 is a front view of a fifth illustrative embodiment of an iron-type head suitable for use with the ball striking device of FIG. 1; and FIG. 17A is a magnified view of a portion of the head of FIG. 17, identified by reference 17A in FIG. 17.

DETAILED DESCRIPTION

Figure 1:
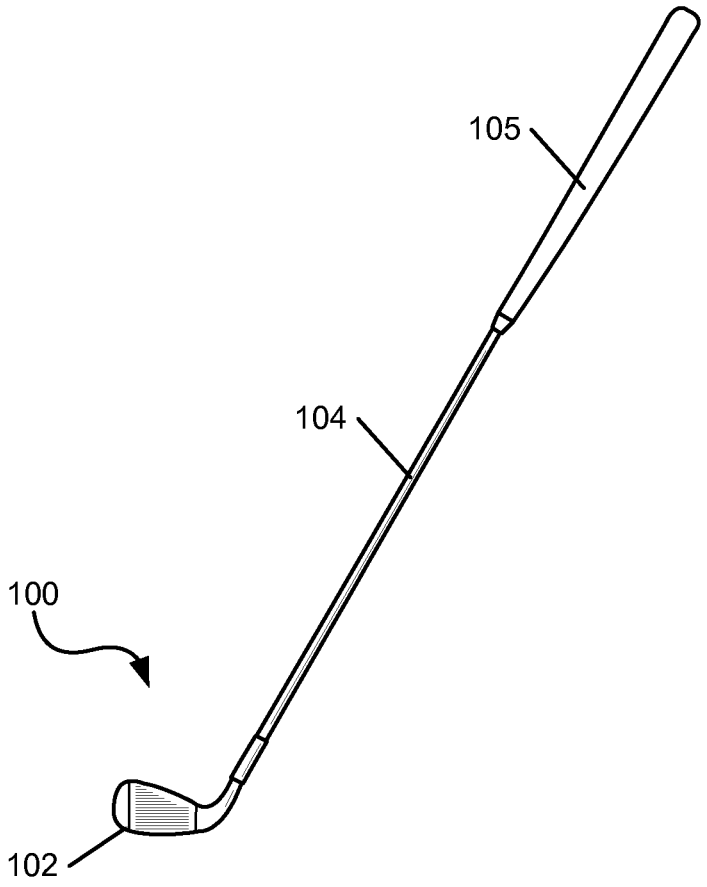
FIG. 1 is a front view of an illustrative embodiment of an iron-type ball striking device according to aspects of the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to iron-type golf clubs and golf club heads, including long irons, short irons, wedges, etc., and to wood-type golf clubs and golf club heads, including drivers, fairway woods, etc. Additionally, some aspects of this invention may be practiced with other types of clubs, such as hybrid clubs, chippers, putters, and the like.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, as well as long iron clubs (e.g., driving irons, zero irons through five irons), short iron clubs (e.g., six irons through pitching wedges, as well as sand wedges, lob wedges, gap wedges, and/or other wedges), hybrid clubs, and putters. Such devices may include a one-piece construction or a multiple-piece construction. Example structures of ball striking devices according to this invention will be described in detail below in conjunction with FIG. 1, which illustrates an example of a ball striking device 100 in the form of an iron-type golf club, and FIG. 12, which illustrates an example of a ball striking device 500 in the form of a wood-type golf club, in accordance with at least some examples of this invention.

FIG. 1 illustrates a ball striking device 100 in the form of a golf iron, in accordance with at least some examples of this invention, and illustrative embodiments of heads 102, et seq., of ball striking devices 100 of this type are shown in FIGS. 2-11. The golf club head 102 of FIG. 1 may be representative of any iron-type golf club head in accordance with examples of the present invention. As shown in FIGS. 1-2, the ball striking device 100 includes a ball striking head 102 and a shaft 104 connected to the ball striking head 102 and extending therefrom. The ball striking head 102 of the ball striking device 100 of FIGS. 1-2 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

As shown in FIGS. 2-6, the golf club head 102 includes a body member 108 having a face 112 and a hosel 109 extending from the body 108 for attachment of the shaft 104. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. The heel portion 120 is attached to and/or extends from the hosel 109 (e.g., as a unitary or integral one piece construction, as separate connected elements, etc.). In the embodiment shown in FIGS. 2-6, the body 108 and the hosel 109 are formed as a single, integral piece, such as by casting, forging, etc. The face 112 may also be formed of the same single, integral piece with the body 108 and the hosel 109. In another embodiment, the face 112, the body 108, and/or the hosel 109 may be formed of two or more separate pieces that are connected together by an integral joining technique or another joining technique. In other applications, such as for a different type of golf club, the head may be designed to have different dimensions and configurations.

The face 112 is located at the front 124 of the head 102, and has an outer surface or ball striking surface 110, as well as a rear surface 111 located opposite the ball striking surface 110, which may be considered an inner surface of the face 112. The face 112 is defined by a plurality of peripheral edges, including a top edge 113, a bottom edge 115, a heel edge 117, and a toe edge 119. The face 112 also has a plurality of face grooves 121 on the ball striking surface 110. In this embodiment, the grooves 121 are parallel or generally parallel and extend laterally across the ball striking surface 110. In another embodiment, the face 112 may have grooves 121 that extend across a portion of the ball striking surface 110.

For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. As seen in the illustrative embodiments in FIGS. 2-6, the ball striking surface 110 is inclined (i.e., at a loft angle), to give the ball an appreciable degree of lift and spin when struck. In other illustrative embodiments, the ball striking surface 110 may have a different incline or loft angle, to affect the trajectory of the ball.

The body 108 and the face 112 of the golf club head 102 may be constructed from a wide variety of different materials, including materials conventionally known and used in the art, such as steel, titanium, aluminum, tungsten, graphite, polymers, or composites, or combinations thereof. Also, if desired, the club head 102 may be made from any number of pieces (e.g., having a separate face mask, etc.) and/or by any construction technique, including, for example, casting, forging, welding, and/or other methods known and used in the art.

The ball striking device 100 may include a shaft 104 connected to or otherwise engaged with the ball striking head 102, as shown in FIG. 1. The shaft 104 is adapted to be gripped by a user to swing the ball striking device 100 to strike the ball. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

Figure 3:
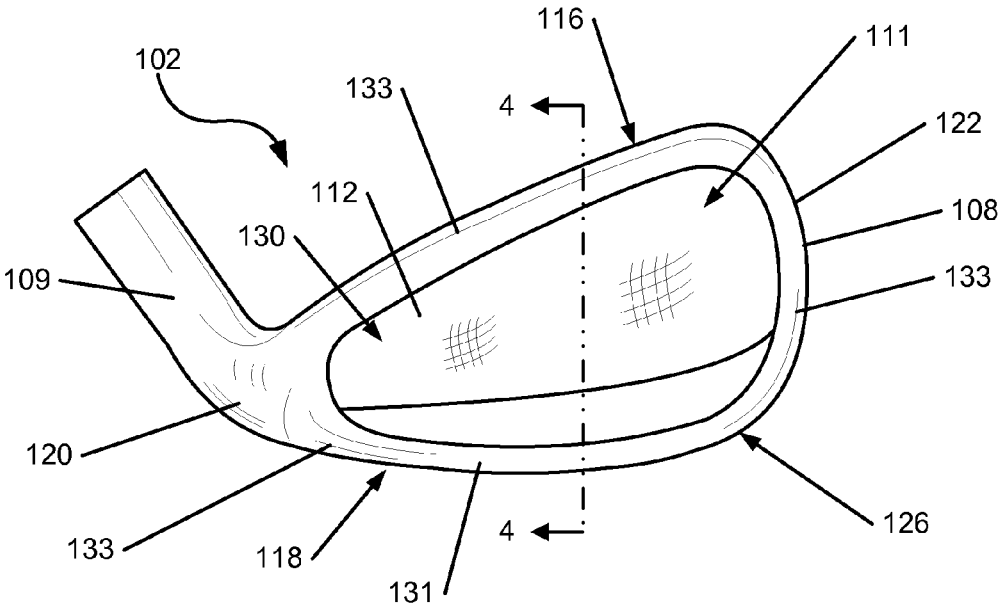
FIG. 3 is a rear view of the head of FIG. 2.
Figure 4:
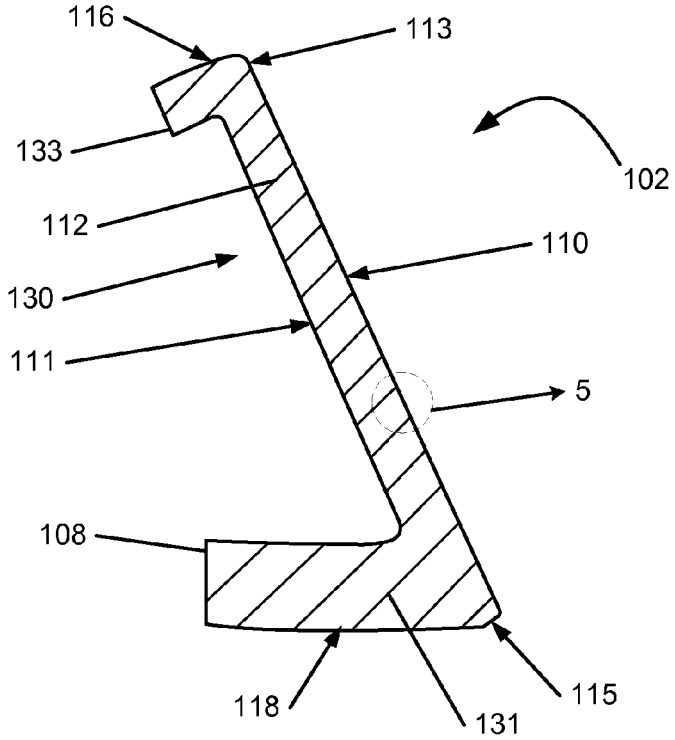
FIG. 4 is a cross-section view of the head of FIG. 3, taken along lines 4-4 of FIG. 3.

In one exemplary embodiment, shown in FIGS. 2-6, the body 108 of the head 102 includes a rear cavity 130 located behind the face 112, which is defined at least partially by the rear surface 111 of the face 112. As shown in FIGS. 2-4, the body 108 further includes a sole body member 131 extending rearward from the bottom edge 115 of the face 112 and defining a portion of the rear cavity 130. The rear cavity 130 may also be partially defined by peripheral or perimeter walls 133 extending rearward from the peripheral edges of the face 112, including the top edge 113, the heel edge 117, and the toe edge 119 of the face 112. It is understood that the sole member 131, or a portion thereof, may be considered to be a peripheral wall 133 as defined herein. The peripheral walls 133 follow the curvilinear contour of the body 108, and form an opening to the rear cavity 130 defined by the peripheral walls 133, including the sole member 131. In additional embodiments, the head 102 may have a differently configured sole member and/or a rear wall, or may not contain some of these components. For example, the features described herein can be used in connection with the embodiments illustrated in FIGS. 7-10 and other known configurations for club heads, including other iron-type club head configurations, as well as hybrid club heads, wood-type club heads, and other types of club heads, such as putters, chippers, etc.

Figure 6:
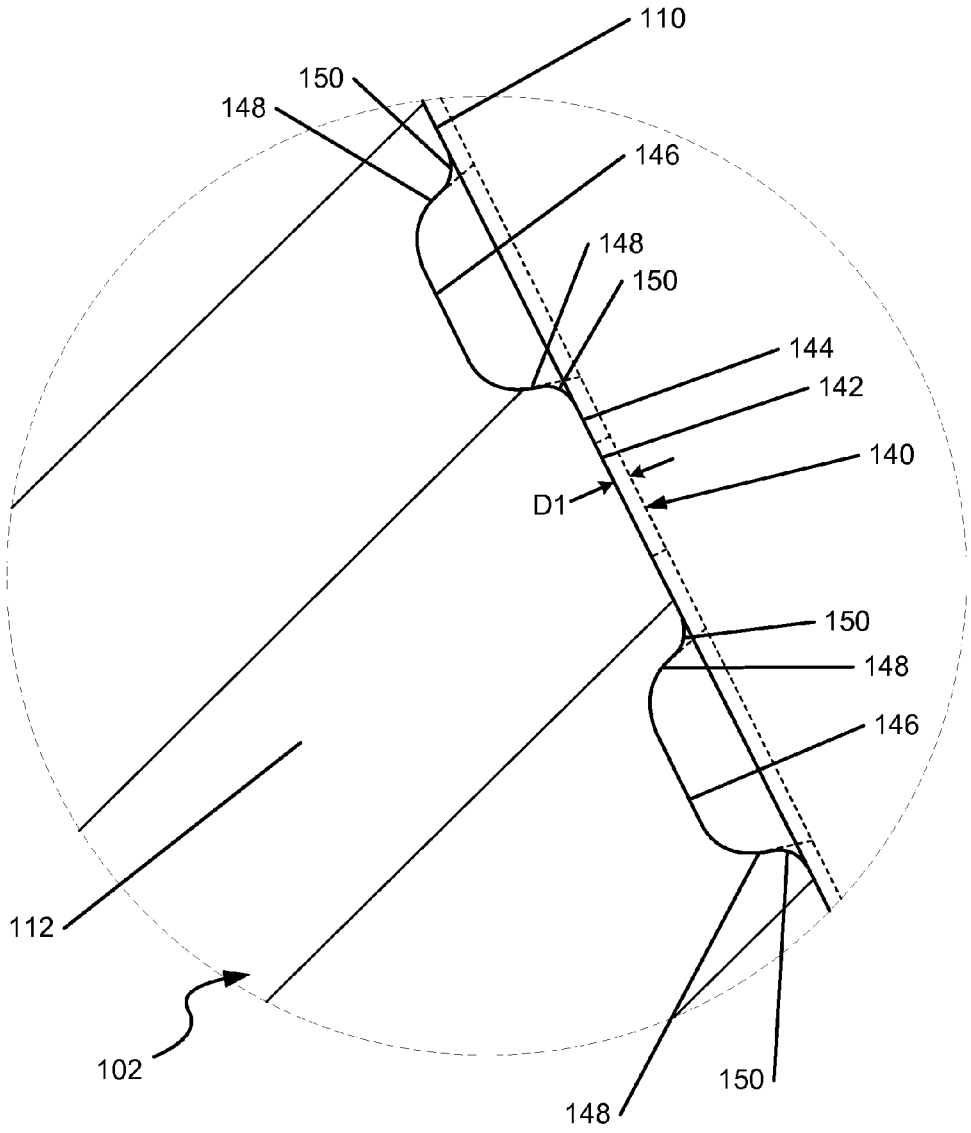
FIG. 6 is a magnified view of the portion of the head illustrated in FIG. 5, shown after wearing away of material on the ball striking surface, with broken lines illustrating material worn away.
Figure 8:
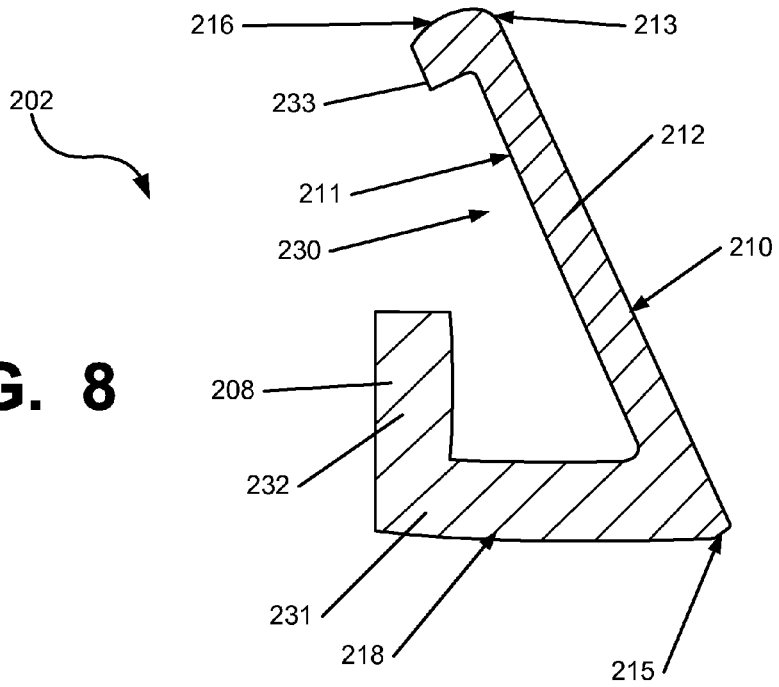
FIG. 8 is a cross-section view of the head of FIG. 8, taken along lines 8-8 of FIG. 7.
Figure 7:
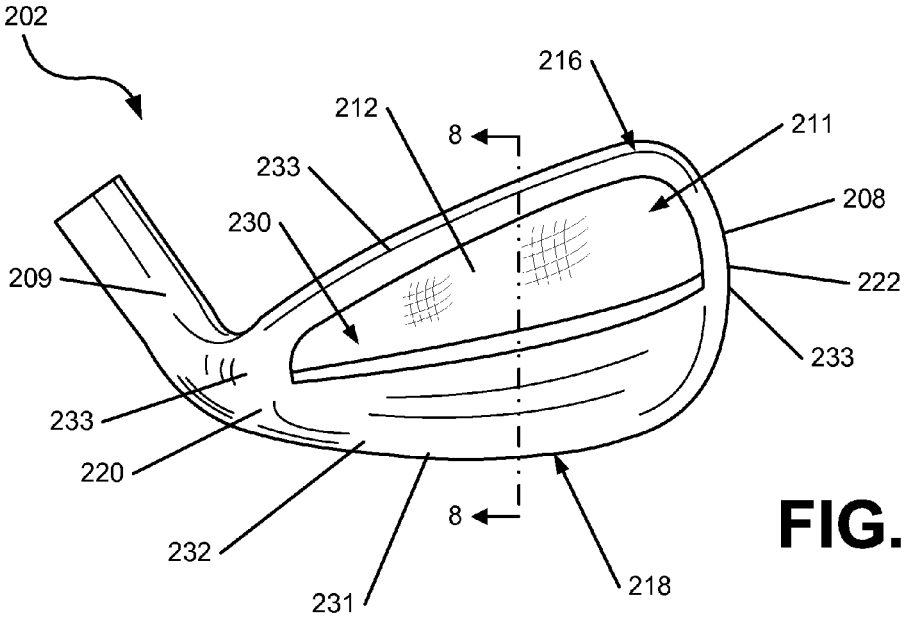
FIG. 7 is a rear view of a second illustrative embodiment of an iron-type head suitable for use with the ball striking device of FIG. 1.

FIGS. 7-8 illustrate another embodiment of an iron-type head 202 for an iron-type golf club 200. Many features of the head 202 of FIGS. 7-8 are similar to the features of the head 102 shown in FIGS. 1-6, and such similar features are identified by similar reference numerals in FIGS. 7-8 using the "2xx" series of reference numerals. Accordingly, certain features of the head 202 of FIGS. 7-8 that are already described above may described below using less detail, or may not be described at all. In this embodiment, the rear cavity 230 may also be partially defined by a rear wall 232 extending upward from the rear of the sole member 231. As shown in FIGS. 7-8, the rear wall 232 partially defines the rear cavity 230, in combination with the sole member 231, the rear surface 211 of the face 212, and the peripheral walls 233 of the head 202, including the sole member 231. It is understood that any features described herein with respect to other embodiments, including the various embodiments of indicators 140, 140', 440, 540, 640, may be used in conjunction with the head 202 of FIGS. 7-8.

Figure 9:
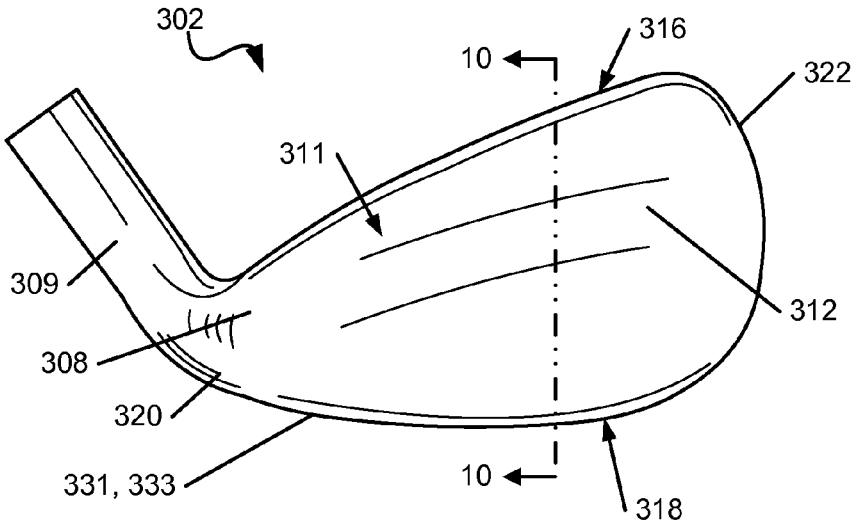
FIG. 9 is a rear view of a third illustrative embodiment of an iron-type head suitable for use with the ball striking device of FIG. 1.
Figure 10:
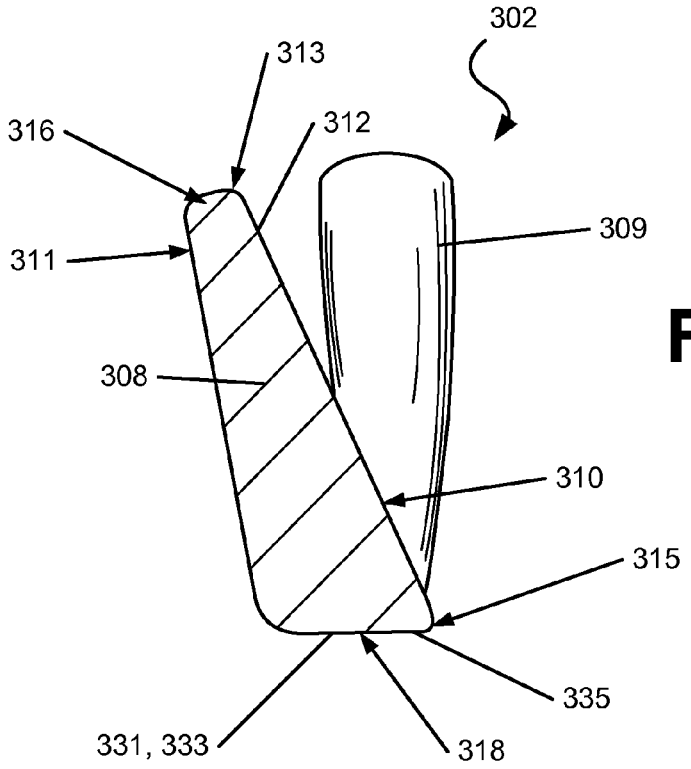
FIG. 10 is a cross-section view of the head of FIG. 9, taken along lines 10-10 of FIG. 9.

FIGS. 9-10 illustrate another embodiment of an iron-type head 302 for an iron-type golf club 300, having a traditional blade-type iron configuration. Many features of the head 302 of FIGS. 9-10 are similar to the features of the head 102 shown in FIGS. 1-6, and such similar features are identified by similar reference numerals in FIGS. 9-10 using the "3xx" series of reference numerals. Accordingly, certain features of the head 302 of FIGS. 9-10 that are already described above may described below using less detail, or may not be described at all. In this embodiment, the head 302 has a traditional blade-type configuration and contains no rear cavity. The peripheral walls 333, including the sole member 331, define a solid body 308 behind the face 312, and the rear surface 311 of the face 312 may also be considered to be a rear surface of the body 308 in this configuration. It is understood that any features described herein with respect to other embodiments, including the various embodiments of indicators 140, 140', 440, 540, 640, may be used in conjunction with the head 302 of FIGS. 9-10.

In general, the head 102 has a ball striking face 110 configured for striking a ball in play. The head 102 also has at least one indicator 140 on the ball striking surface 110, which is configured to physically change after repeated and continued use, to visually indicate to the user when the club head may be suitable for replacement, such as due to excessive wear on the face 112. For example, the indicator 142 may be configured to fade and/or disappear before the wear on the club head reaches excessive levels. In one embodiment, the indicator is formed by one or more indents 142 on the ball striking surface 110, located between the face grooves 121. In this arrangement, the indent 142 may be configured so that material worn away due to wearing on the ball striking surface will reach the approximate depth of the indent 142 on or before the user may desire replacement, such as when the radius of curvature of the edge of any of the grooves reaches a specified maximum or the face has thinned to a point where the risk of rupture is elevated. In other embodiments, the indicator 140 may have a different configuration. A number of different embodiments illustrating a variety of examples of such different configurations are shown in FIGS. 2-15 and described below.

FIGS. 2-6 illustrate one example embodiment of a head 102 in accordance with the present invention. As described above, the head 102 has a body 108 with a face 112 connected to the body 108, with the face 112 having a ball striking surface 110 and a plurality of face grooves 121 extending across the ball striking surface 110. An indicator 140 is located on the ball striking surface 110, in the form of a plurality of indents 142 formed between the face grooves 121. In this embodiment, the indents 142 are positioned in a straight line within a lateral space 144 defined between two of the face grooves 121. Additionally, the indents 142 are located below the vertical centerline of the face 112, and at least some of the indents 142 are located proximate the lateral centerline of the face 112, so that at least some of the indents 142 are positioned where the most frequent impacts occur on the ball striking surface 110 (i.e. the "hot zone" of the face 112). FIG. 2A illustrates the circular or generally circular shape and the relative size and position of one of the indents 142 in the head 102 of FIG. 2. It is understood that the indents 142 can be differently sized and/or positioned.

Figure 5:
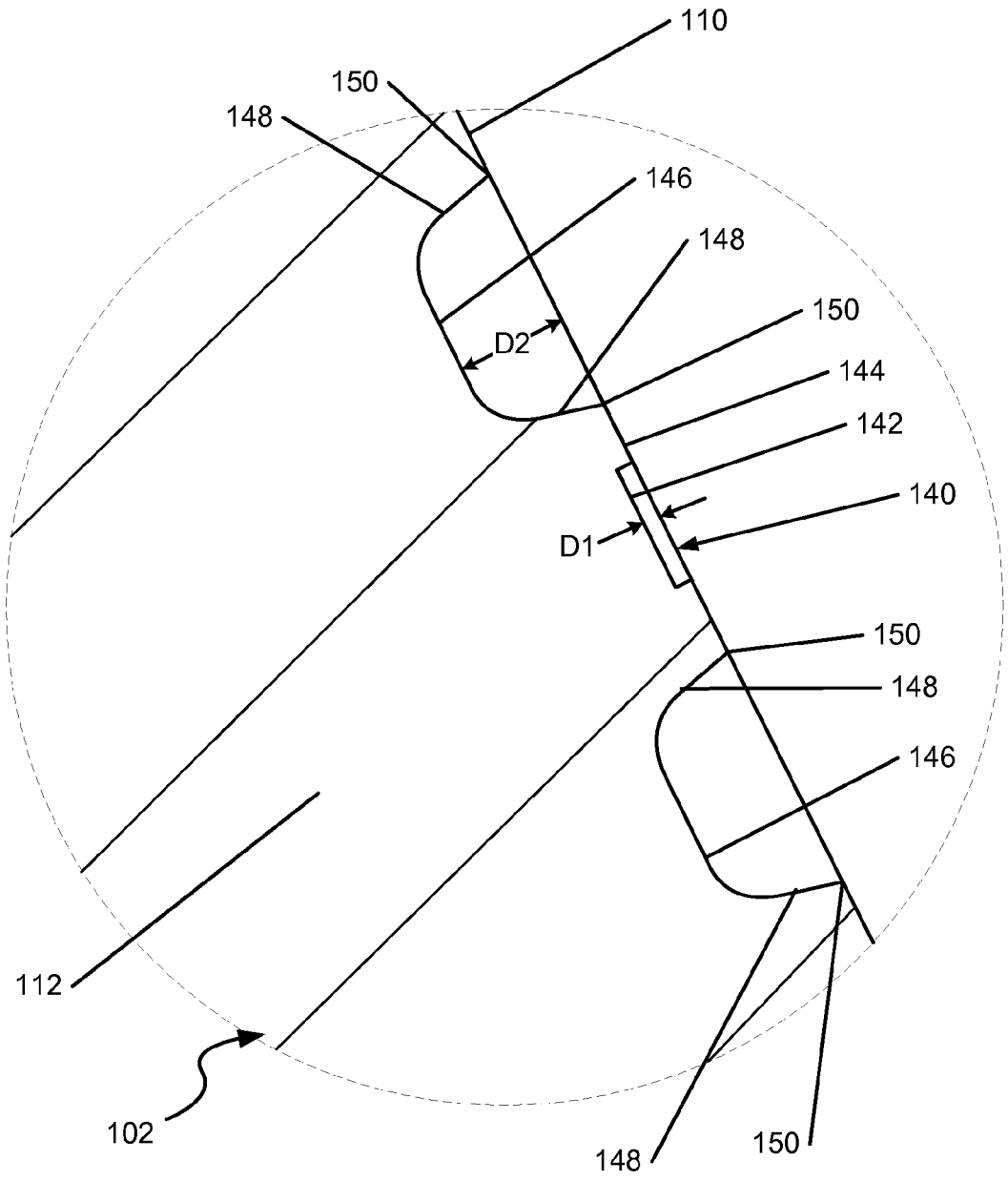
FIG. 5 is a magnified view of a portion of the head of FIG. 4, identified by reference 5 in FIG. 4.

FIGS. 5-6 illustrate the indent 142 of FIG. 2A, along with the adjacent face grooves 121 in greater detail. The grooves 121 are recessed into the face 112 and have a trough 146 at the bottom and sides 148 extending up to the ball striking surface 110. Edges 150 where the sides 148 meet the ball striking surface 110 define the boundaries of each groove 121. The grooves 121 illustrated in FIGS. 5-6 are flat-bottomed U-shaped grooves, but other known groove types may be used in other embodiments, including V-shaped grooves, rounded-bottom grooves, and grooves with tapered depths, as some examples.

As described above, the indicator 140 is configured to give a visual indication to the user when the head 102 may need replacement due to wear on the face 112. For example, the iron-type head 102 may be considered to require replacement when the wear on the face 112 causes the edges 150 of the grooves 121 to lose sharpness to a degree that the face 112 can no longer impart adequate or satisfactory spin to the ball upon contact. The sharpness of the edges 150 can be expressed by the cross-sectional radius of curvature of the edges 150, as shown in FIGS. 5-6, which can be measured by the two-circles test referenced above. In this embodiment, the depth of recess of the indicator 140 into the ball striking surface 110 is such that material worn away due to wearing on the ball striking surface 110 will reach the approximate depth of the indent 142 on or before the radius of curvature of any of the edges 150 of the grooves 121 becomes excessively dull (i.e. reaches a limit or maximum radius of curvature). In one example, the initial effective radius of curvature of the edge 150 of the groove 121 is approximately 0.010", the depth D1 of the indent 142 will be reached due to wear on the ball striking surface 110, and the indent 142 will fade and/or disappear, at or before the radius of curvature of any of the edges 150 of any of the grooves 121 reaches a point at which the grooves 121 are no longer effective for imparting satisfactory spin on the ball. In another embodiment, the depth D1 of recess of the indicator 140 into the ball striking surface 110 is such that material worn away due to wearing on the ball striking surface 110 will reach the approximate depth of the indent 142 on or before the face 112 loses sufficient effectiveness in imparting spin to the ball.

The necessary depth of the indent 142 may vary depending on many factors, such as the material of the face 112 and the properties (e.g. strength, hardness, etc.) thereof; the loft angle of the club, which can cause the grooves 121 to wear more quickly or slowly; the usage of the club, such as usage in sand, dirt, grass, etc., which may cause greater wear, and other factors. In one embodiment, the depth of the indent 142 may be 0.001" or less. In another embodiment, the depth of the indent 142 may be 0.005" or less. In further embodiments, the depth of the indent 142 may be different, and may be limited by applicable USGA regulations. It is understood that other depths can be used based on consideration of the above factors or other factors.

FIG. 6 illustrates the face 112 of FIG. 5 after material has been worn away from the ball striking surface 110 (denoted by broken lines) and has reached the depth D1 of the indent 142, causing the indent 142 to visually fade or disappear from the face 112. As also seen in FIG. 6, the edges 150 of the grooves 121 have become more rounded and less sharp due to the wear on the face 112. In this condition, the visual disappearance of the indent 142 enables the indicator 140 to give a visual indication to the user that the face 112 may be excessively worn and may be eligible for replacement. The indicator 140 on the head 102 of FIGS. 2-6 includes a plurality of indents 142, as shown in FIG. 2. In one embodiment, the indicator 140 is configured so that if any one or more of the indents 142 fade or disappear from the face 112, such as the indent 142 in FIG. 2A that is located in the center of the ball striking surface 110, the head 102 is considered to be suitable for replacement. However, in other embodiments, the head 102 may not be suitable for replacement until a specified number of the indents 142 have disappeared, such as two indents 142, three indents 142, a majority of the indents 142, or all of the indents 142, in various examples. In further embodiments, the indicator 140 may have a different configuration, and may provide the visual indication to the user in a different manner.

In this embodiment, the depth D1 of the indent 142 substantially less than the depth D2 of any of the face grooves 121, as shown in FIG. 5. For example, in one embodiment, the depth D1 of the indent 142 is less than 2% of the deepest depth D2 of the face grooves 121, and may be less than 1% of the deepest depth D2 of the face grooves 121. In one example embodiment, the depth D1 of the indent 142 is up to 180 μ-inches, and the depths D2 of the grooves are up to 0.020", falling within USGA regulations. The depths D1, D2 of the indents 142 and the grooves 121 may be as deep as permitted by USGA regulations, and the relative depth D1 of the indent 142 may change accordingly. It is noted that the relative sizes and depths D2, D1 of the grooves 121 and the indent 142 in FIGS. 5-6 are exaggerated and distorted to permit more clear depiction of detail; for example, the depth of the indent 142 in FIG. 5 is depicted as being larger than 1-2% of the depth of the grooves 121, and the radius of curvature of the edges 150 may also not be depicted to scale.

The depth D1 of the indent 142 may be selected in order to provide a visual indication to the user at a specified time and/or degree of wear on the face 112. The selection of the depth D1 of the indent 142 may depend on many factors, such as the nature and properties of the face 112 (including the wear resistance of the face 112). These properties of the face 112 can be influenced by the materials forming the face 112, which can create a harder or softer ball striking surface 110 that may be more or less resistant to wear. Any surface finish, plating (such as Ni—Cr plating), face insert, or other surface treatment may also affect the wear resistance and other properties of the face 112. Other factors which may influence the selection of the depth D1 of the indent 142 include the initial sharpness of the edges 150 of the grooves 121, and/or the desired amount of wear that the face 112 will undergo before replacement, among other factors. For example, a recreational or amateur golfer may be willing to tolerate a higher degree of wear on the face 112 before replacement, whereas a professional golfer may demand replacement at a lesser degree of wear. Additionally, because different users may desire visual notifications at different times, the depth D1 of the indent 142 may be customized to a particular user, to reflect the degree of wear that the user is willing to tolerate on the face 112 before replacement.

The indicator 140 may additionally or alternately be used as an indication of a degree of wear on the face 112 or on a specific location on the face 112. For example, as one or more of the indents 142 begin to fade or disappear due to wear, it may be evident to the user that the face 112 is becoming more worn. As another example, some of the indents 142 may fade or disappear more quickly than others, due to a disproportionate number of ball impacts in a particular area of the face 112 relative to other areas. If a user frequently hits the ball in the center of the face, the indents 142 in the center may fade more quickly and create a visual indication of the user's hitting pattern. Likewise, if the user frequently hits the ball more toward the heel or toe edges 117, 119 of the face 112, the indicator 140 may give a visual indication of that hitting pattern. In one embodiment, the face 112 may include indents 142 or other indicators 140 that are more distributed across the face 112, which can provide information regarding hitting patterns across the face 112.

Figure 16:
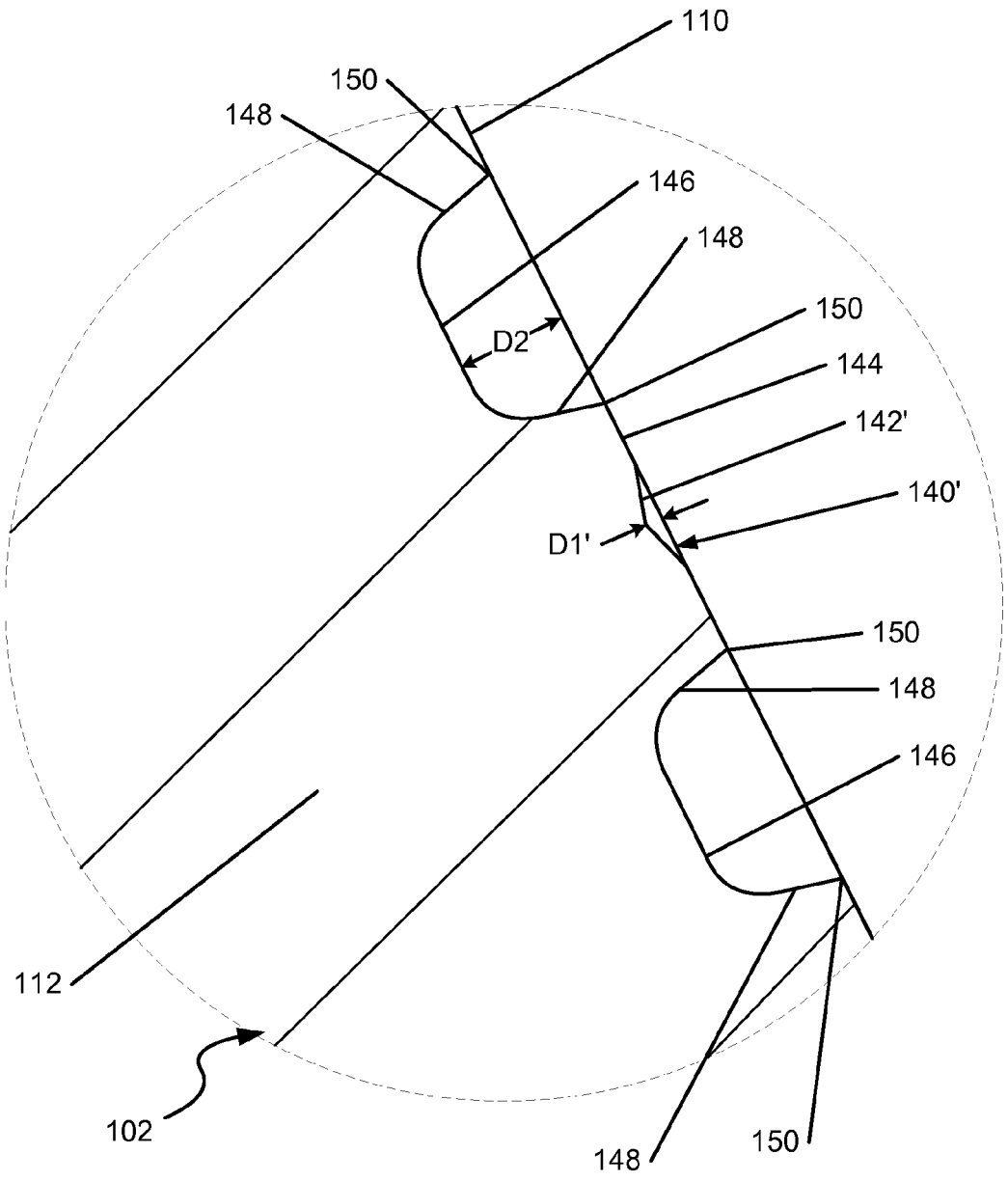
FIG. 16 is a magnified cross-section view of a portion of another illustrative embodiment of a ball striking device according to aspects of the present invention.

The indicator 140 may be formed on the face 112 using any of a variety of different methods. In one embodiment, the indents 142 are formed using a laser, such as with a laser etching technique using a YAG laser or other type of laser. If the face 112 is coated, such as by plating with nickel-chrome or another coating, the indicator 140 may be formed on the face 112 after the coating is applied. Similarly, in other embodiments, the indicator 140 may be formed after the head 102 is fully formed and assembled, or as an intermediate step during the assembly process. In another embodiment, the indents 142 are formed using a machining or milling technique, a stamping technique, a chemical etching technique, or any of a number of different suitable techniques. In further embodiments, where the indicator 140 has a different configuration, additional techniques may be used. The indicator 140 may also include an additional material in one embodiment, such as a paint, pigment, dye, coating, etc., which may wear away during use and increase the visibility of the indicator 140. In the embodiment shown in FIGS. 2-6, the indent 142 is formed as a circular recess with a relatively flat bottom. It is understood that various different techniques may produce an indent 142 having a particular shape or contour, and that differently-shaped indents 142 can be used in other embodiments. For example, the indent 142 may have a square or rectangular profile in one embodiment, or may have an annular or ring shape in another embodiment. As another example, the indent 142 may have a different cross-sectional shape. For example, FIG. 16 illustrates the head 102 of FIGS. 1-6 with an alternate embodiment of an indicator 140' with an indent 142' that has a more pointed cross-sectional shape. Such an indent 142' may be formed using any of the methods described herein. The indent 142' of FIG. 16 functions similarly to the indent 142 of FIGS. 2-6, by providing a replacement indication to the user when wearing away of material of the face 112 reaches the depth D1' of the indent 142', causing the indent 142' to fade or disappear. It is understood that the indents 142, 442, 542, 642 described herein may have a configuration as shown in FIG. 16.

FIGS. 11 and 11A illustrate another embodiment of an iron-type head 402 for an iron-type golf club 400. Many features of the head 402 of FIGS. 11 and 11A are similar to the features of the head 102 shown in FIGS. 1-6, and such similar features are identified by similar reference numerals in FIGS. 11 and 11A using the "4xx" series of reference numerals. Accordingly, certain features of the head 402 of FIGS. 11 and 11A that are already described above may described below using less detail, or may not be described at all. In this embodiment, the indicator 440 is formed by an elongated, linear indent or recess 442 that extends across the ball striking surface 410. Like the row of indents 142 described above and shown in FIGS. 2-6, the indent 442 is located between two of the face grooves 421 on the face 412, and is located below the vertical centerline of the face 412 and across the lateral centerline of the face 112, as illustrated in greater detail in FIG. 11A, so that at least a portion of the indicator 440 is positioned in the hot zone of the face 412, where impacts most frequently occur. The indent 442 in FIGS. 11 and 11A may have a cross-sectional shape similar to the indent 142 as shown in FIGS. 5-6, or may have a different shape, such as the indent 142' shown in FIG. 16 and described above. In this embodiment, the indicator 440 may be considered to provide an indication that the head 402 is suitable for replacement when any portion of the indent 442 has faded or disappeared, due to wearing away of the material of the ball striking surface 410 to reach the depth of the indent 442, as described above. In another embodiment, the indicator 440 may be considered to provide the replacement indication when a certain specified length or proportion of the indent 442 has worn away. It is understood that any features described herein with respect to other embodiments may be used in conjunction with the head 402 of FIGS. 11 and 11A.

FIGS. 17 and 17A illustrate another embodiment of an iron-type head 702 for an iron-type golf club 700. Many features of the head 702 of FIGS. 17 and 17A are similar to the features of the head 102 shown in FIGS. 1-6, and such similar features are identified by similar reference numerals in FIGS. 17 and 17A using the "7xx" series of reference numerals. Accordingly, certain features of the head 702 of FIGS. 17 and 17A that are already described above may described below using less detail, or may not be described at all. In this embodiment, the indicator 740 is formed by an elongated, linear indent or recess 742 that extends across the ball striking surface 710 at the bottom edge 715 of the face 712. In this embodiment, the indent 742 is located below the lowermost face groove 721 on the face 712, and is located across the lateral centerline of the face 712, as illustrated in greater detail in FIG. 17A. In one embodiment, the indent 742 may be located on a curved portion of the edge 715, at the juncture between the face 712 and the body 708, rather than on the flat portion of the face 712. In one embodiment, the indent 742 may have a depth of 0.005" or less, and in other embodiments, the indent 742 may have a depth of 0.001" or less or a depth of 180 μ-inches or less. The indent 742 in FIGS. 17 and 17A may have a cross-sectional shape similar to the indent 142 as shown in FIGS. 5-6, or may have a different shape, such as the indent 142' shown in FIG. 16 and described above. In this embodiment, the indicator 740 may be considered to provide an indication that the head 702 is suitable for replacement when the indent 742 has partially or completely faded or disappeared, due to wearing away of the material of the ball striking surface 710 to reach the depth of the indent 742, as described above. It is understood that any features described herein with respect to other embodiments may be used in conjunction with the head 702 of FIGS. 17 and 17A.

Figure 12:
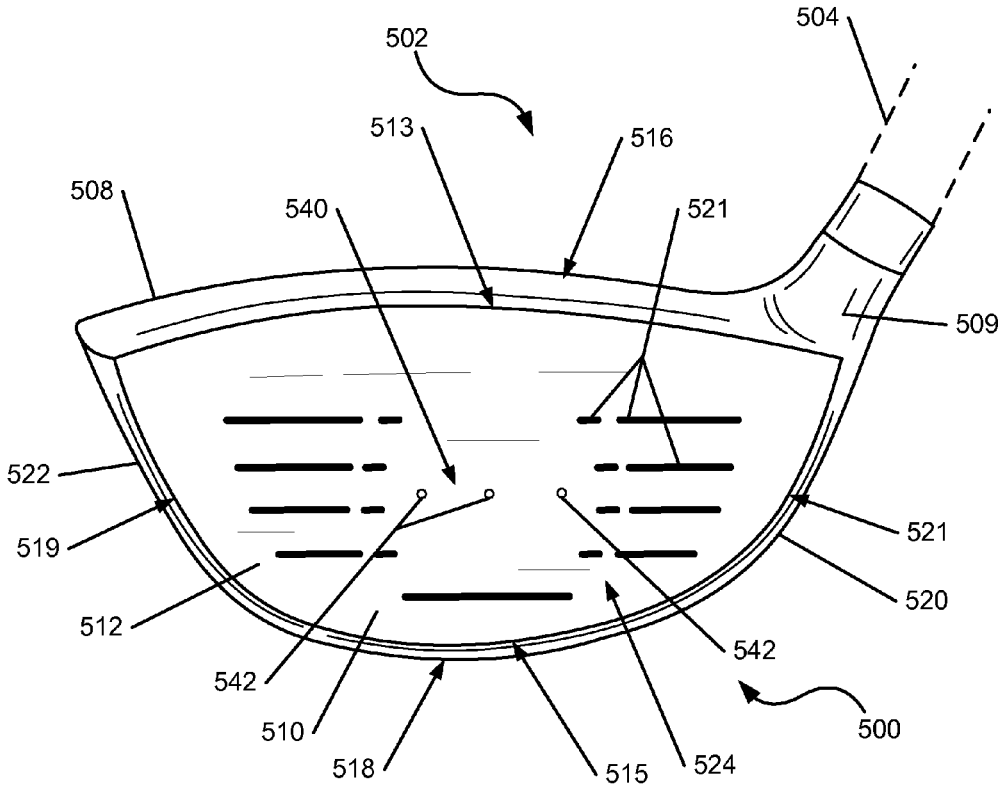
FIG. 12 is a front view of an illustrative embodiment of a wood-type head of a ball striking device according to aspects of the present invention.
Figure 13:
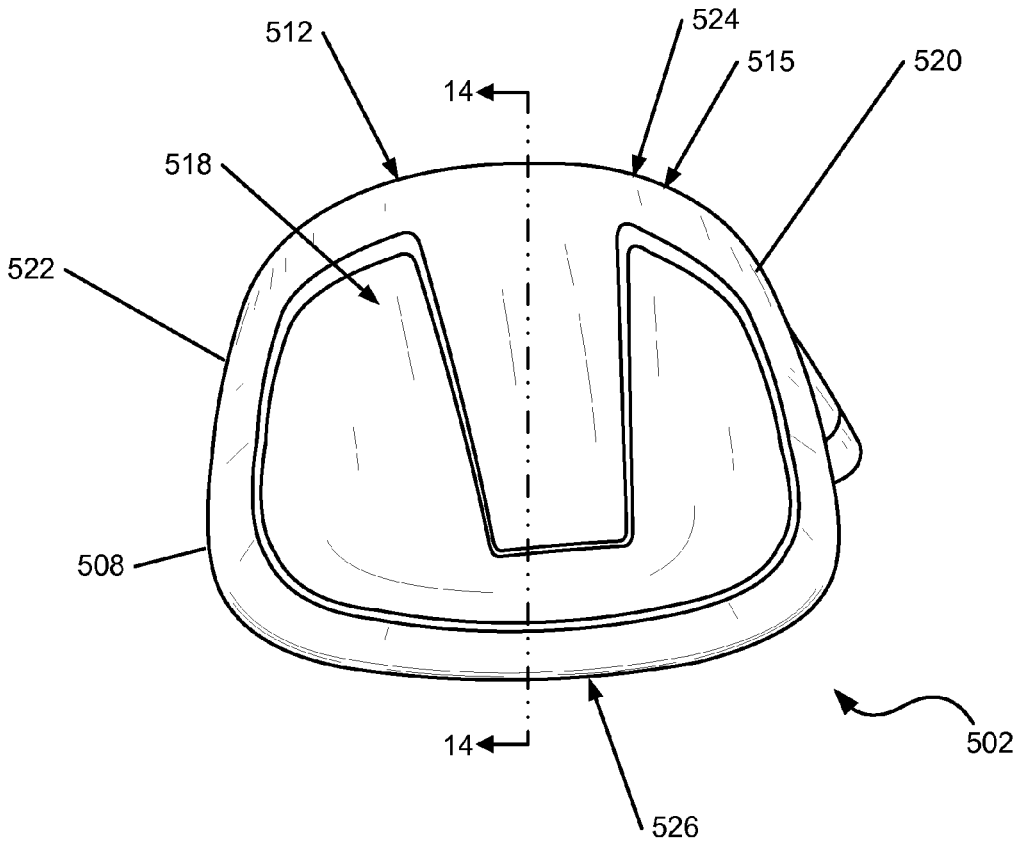
FIG. 13 is a bottom view of the head of FIG. 12.
Figure 14:
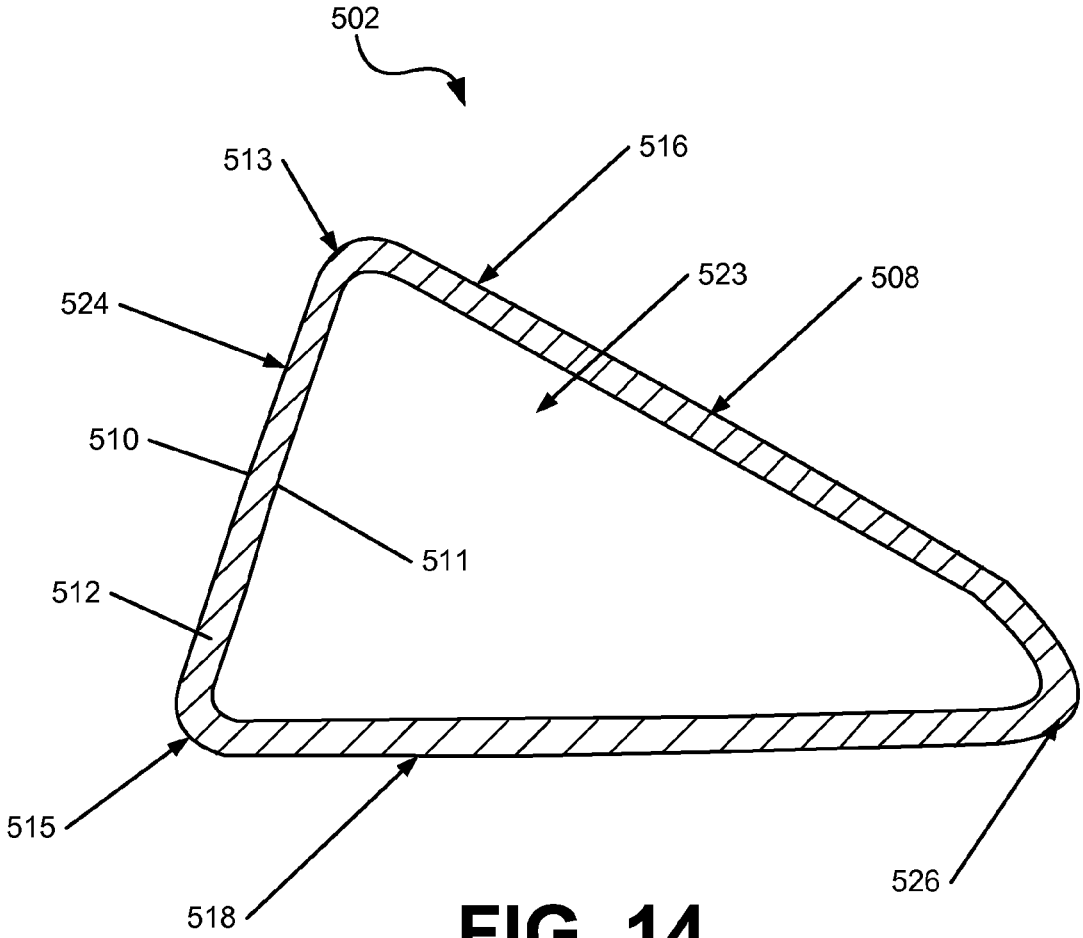
FIG. 14 is a cross-section view of the head of FIG. 13, taken along lines 14-14 of FIG. 13.

FIGS. 12-14, illustrate another example embodiment of a ball striking device 500 in the form of a wood golf club (such as a driver) or other wood-type club, including fairway wood, a hybrid club, etc. The golf club 500 shown in FIGS. 12-14 includes a ball striking head 502 configured to strike a ball in use and a shaft 504 connected to the ball striking head 502 and extending therefrom. Although the head 502 is a wood-type head, which differs from the iron type heads 102, et seq., described above, many features of the head 502 of FIGS. 12-14 are similar to the features of the head 102 shown in FIGS. 2-6, and such similar features are identified by similar reference numerals in FIGS. 12-14 using the "5xx" series of reference numerals. Accordingly, certain features of the head 502 of FIGS. 12-14 that are already described above may described below using less detail, or may not be described at all.

The ball striking head 502 of the golf club 500 of FIGS. 12-14 has a face 512 connected to a body 508, with a hosel 509 extending therefrom. Any desired hosel and/or head/shaft interconnection structure may be used without departing from this invention, including those described above. The head 502 has an enclosed volume, as the club head 502 is a wood-type club head designed for use as a driver, intended to hit the ball accurately over long distances. In other applications, such as for a different type of golf club, the head 502 may be designed to have different dimensions and configurations. For example, in the embodiment shown in FIGS. 12-14, the club head 502 may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

In the embodiment illustrated in FIG. 13, the body 508 of the head 502 has a squared of rectangular rear profile. In other embodiments, the body 508 of the head 502 can have another shape or profile, including a rounded shape or other any of a variety of other shapes. It is understood that such shapes may be configured to distribute weight away from the face 512 and/or the geometric/volumetric center of the head 502, in order to create a lower center of gravity and/or a higher moment of inertia. The golf club 500 may include a shaft 504 connected to or otherwise engaged with the ball striking head 502 as illustrated schematically in FIGS. 12-14, and as similarly shown in FIGS. 1-2 and described above.

In the illustrative embodiment illustrated in FIGS. 12-14, the head 502 has a hollow structure defining an inner cavity 523 with a plurality of inner surfaces defined therein. As shown in FIG. 14, the inner cavity 523 may be filled with air. However, in other embodiments, the head could be filled with another material, such as foam. In still further embodiments, the solid materials of the head may occupy a greater proportion of the volume, and the head may have a smaller cavity or no inner cavity at all. It is understood that the inner cavity 523 may not be completely enclosed in some embodiments.

The face 512 in FIGS. 12-14 is located at the front 524 of the head 502, and has an outer surface 510 and an inner surface 511 opposite the outer surface 510. As shown, the outer surface 510 of the face 512 is substantially flat, and has a plurality of outer or peripheral edges, including a top edge 513, a bottom edge 515, and lateral edges (including heel edge 517 and toe edge 519). In the illustrative embodiment shown in FIGS. 12-14, the outer or ball striking surface 510 of the face 512 is inclined (i.e., at a loft angle), to give the ball a desired lift and spin when struck. The loft angle of the face 512 may be different in different embodiments, to affect the trajectory of the ball. Additionally, in this embodiment, the face 512 has a plurality of face grooves 521 on the ball striking surface 510, which do not extend across the hot zone at the center of the face 512, in contrast to the face grooves 121 of the iron-type head 102 described above. In another embodiment, such as the fairway wood head 602 shown in FIG. 15 or a hybrid wood-type head, the face 612 may have grooves 621 that extend across at least a portion of the hot zone of the face 612, in order to impart increased spin to the ball, as described in greater detail below.

It is understood that the face 512, the body 508, and/or the hosel 509 can be formed as a single piece or as separate pieces that are joined together. The face 512 may be formed as part of a face frame member with the body 508 being partially or wholly formed by one or more separate pieces connected to the face frame member, with a wall or walls extending rearward from the edges of the face 512. This configuration (not shown) is also known as a "cup face" structure. Additionally, at least a portion of the body 508 may be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining. Other known techniques for joining these parts can be used as well, including many mechanical joining techniques, including releasable mechanical engagement techniques. If desired, the hosel 509 may be integrally formed as part of the face frame member. Further, a gasket (not shown) may be included between the cup face structure and the backbody member.

The head 502 of FIGS. 12-14 includes an indicator 540 located on the ball striking surface 510, in the form of a plurality of indents 142 formed across the center of the hot zone of the face 512 and between the face grooves 521. In this embodiment, the indicator 540 includes three indents 542 positioned in a straight line within a space 544 defined around the hot zone of the face 512. The indents 542 are located approximately in alignment with the vertical centerline of the face 512, and proximate the lateral centerline of the face 512, so that at least some of the indents 542 are positioned where the most frequent impacts occur on the ball striking surface 510 (e.g. the hot zone of the face 512). The indents 542 have a circular or generally circular shape, similar to the indents 142 shown in FIG. 2A. It is understood that the indents 542 can be differently sized and/or positioned, as similarly described above.

In this embodiment, the cross-sectional shapes of the indents 542 are similar to the shape of the indent 142 in FIGS. 5 and 6. As similarly described above, the indicator 540 is configured to give a visual indication to the user when the head 502 may need replacement due to wear on the face 512. For example, the wood-type head 502 may be considered to require replacement when the wear on the face 512 reaches the point that a substantial risk exists that the face 512 may rupture on impact with the ball. In this embodiment, the depth of recess of the indicator 540 into the ball striking surface 510 is such that material worn away due to wearing on the ball striking surface 510 will reach the approximate depth of the indent 542 on or before the face 512 becomes thin and/or weak enough that a significant chance of rupture exists. In one example, the depth of the indent 542 will be reached due to wear on the ball striking surface 510, and the indent 542 will fade and/or disappear, at or before a chosen percentage of the expected lifetime of the face 512 is reached.

The indents 542 in the embodiment of FIGS. 12-14 are worn away through use, similarly to the indents 142 in FIGS. 5-6. In this condition, the visual disappearance of the indent 542 enables the indicator 540 to give a visual indication to the user that the face 512 may be excessively worn and may be eligible for replacement. The indicator 540 on the head 502 of FIGS. 12-14 includes a plurality of indents 542, as shown in FIG. 12. In one embodiment, the indicator 540 is configured so that if any one or more of the indents 542 fade or disappear from the face 512, the head 502 is considered to be suitable for replacement. However, in other embodiments, the head 502 may not be suitable for replacement until a specified number of the indents 542 have disappeared, such as two indents 542, a majority of the indents 542, or all of the indents 542, in various examples. In further embodiments, the indicator 540 may have a different configuration, and may provide the visual indication to the user in a different manner.

In this embodiment, the depth of the indent 542 substantially less than the depth of any of the face grooves 521, as described above, and the relative depth of the indent 542 may be similar to the relative depth of the indent 142 described above. As similarly described above, the selected depth of the indent 542 may depend on many factors, such as the nature and properties of the face 512, including the wear resistance of the face 512 and the strength and risk of rupture of the face 512, which may be related to the properties and identity of the face material(s) and structure. As also described above, a recreational or amateur golfer may be willing to tolerate a higher degree of wear on the face 512 before replacement, whereas a professional golfer may demand replacement at a lesser degree of wear. Additionally, because different users may desire visual notifications at different times, the depth of the indent 542 may be customized to a particular user, to reflect the degree of wear and the risk of rupture that the user is willing to tolerate on the face 512 before replacement.

Figure 15:
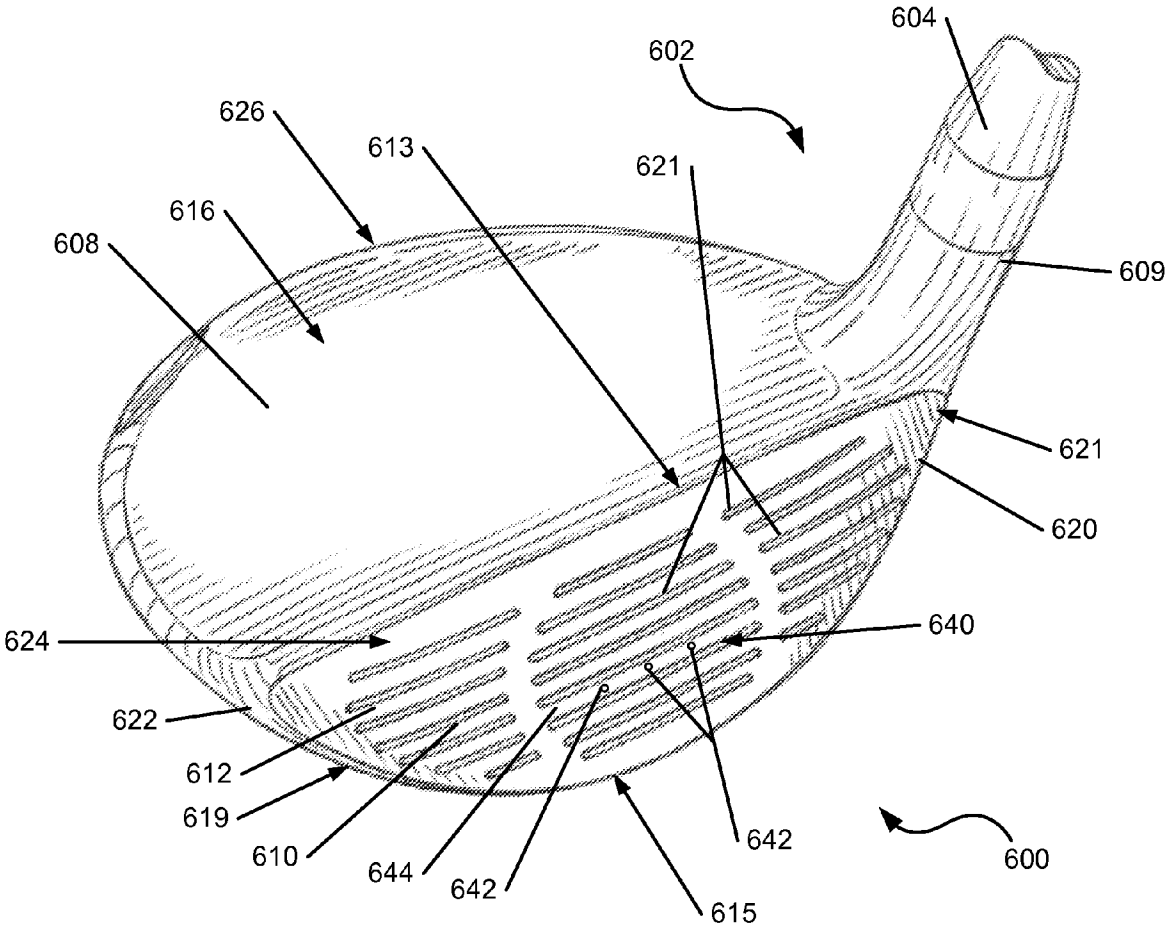
FIG. 15 is a perspective view of another illustrative embodiment of a wood-type head of a ball striking device according to aspects of the present invention.

FIG. 15 illustrates a further example embodiment of a ball striking device 600 in the form of a fairway wood golf club (such as a 3-wood, 5-wood, etc.) or other wood-type club, including driver, a hybrid club, etc. The golf club 600 shown in FIG. 15 includes a ball striking head 602 configured to strike a ball in use and a shaft 604 connected to the ball striking head 602 and extending therefrom. Although the head 602 is a wood-type head, which differs from the iron type heads 102, et seq., described above, many features of the head 602 of FIG. 15 are similar to the features of the head 102 shown in FIGS. 2-6, and such similar features are identified by similar reference numerals in FIG. 15 using the "6xx" series of reference numerals. Additionally, many of the features of the head 602 are similar to the features of the wood-type driver head 502 in FIGS. 12-14. Accordingly, certain features of the head 602 of FIG. 15 that are already described above may described below using less detail, or may not be described at all.

The head 602 of FIG. 15 includes a plurality of parallel or substantially parallel face grooves 621 on the ball striking surface 610, to impart greater spin to the ball when struck, which differs from the head 502 of FIGS. 12-14, which does not contain face grooves 521 across the hot zone of the face 512. The head 602 also includes an indicator 640 located on the ball striking surface 610, in the form of a plurality of indents 642 formed across the center of the hot zone of the face 612 and between the face grooves 621. In this embodiment, the indicator 640 includes three indents 642 positioned in a straight line within a lateral space 644 defined between a selected pair of the face grooves 621. The indents 642 are located slightly below the vertical centerline of the face 612, and proximate the lateral centerline of the face 612, so that at least some of the indents 642 are positioned where the most frequent impacts occur on the ball striking surface 610 (i.e. the "hot zone" of the face 612). The indents 642 are structured and shaped similarly to the indents 142, 542 described above.

In this embodiment, the indents 642 can be configured such that visual disappearance of the indent 642 enables the indicator 640 to give a visual indication to the user that the face 612 may be excessively worn and may be eligible for replacement. The indicator 640 may be configured to provide a visual indication for replacement of the face 612 based on the edges of the grooves 621 losing sharpness, as similarly described above with respect to the head 102 of FIGS. 1-6, and/or to provide a visual indication that the face 612 has thinned or weakened to the point where a significant chance of rupture would occur, as similarly described above with respect to the head 502 of FIGS. 12-14. As similarly described above, the indicator 640 is configured for providing the indication when removal of material due to wearing on the face 612 reaches the depth of the indent 642, causing the indent to disappear. In another embodiment, the face 612 may include one indicator that indicates replacement based on wear on the edges of the grooves 621 and another indicator that indicates replacement based on the risk of rupturing the face 612.

Several different embodiments have been described above, including the various embodiments of golf clubs 100, 500 and heads 102, 202, 302, 402, 502, 602 and portions thereof described herein. It is understood that any of the features of these various embodiments may be combined and/or interchanged. For example, as described above, various different combinations of club heads 102, et seq. with differently configured face grooves 121, et seq. and indicators 140, et seq. may be used, including the configurations described herein, variations or combinations of such configurations, or other configurations. In further embodiments, at least some of the features described herein can be used in connection with other configurations of iron-type clubs, wood-type clubs, other golf clubs, or other types of ball-striking devices.

Heads 102, et seq. incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head with an indicator and/or other features described herein.

Additionally, the head 102, et seq., golf club 100, et seq., or other ball striking device may be fitted or customized for a person by custom fitting, which may include selecting a configuration of an indicator 140, et seq., such as by selecting a shape/profile and depth of an indent 142 et seq., based on a user's desired level of wear on the face 112, et seq. before replacement of the head 102, et seq. As described above, other factors may be used in this selection, including the initial configuration of the face 112, et seq. and the nature and properties of the material of the face 112, et seq. Such customization may also include analyzing a golfer's hitting patterns to position at least a portion of the indicator 140 et seq. (e.g., at least some of the indents 142, et seq.) in the location of the face 112, et seq. where impacts most frequently occur during use by the user. The head 102 et seq. and/or the entire club 100, et seq. may be replaced when the indicator 140, et seq. provides the visual indication for replacement. Various other configurations are possible, and various other club heads may be designed for various performance characteristics.

Heads 102 et seq. and other ball striking devices as described above may be supplied to a user and then replaced when the indicator 140 et seq. provides an indication that the face 112 et seq. may be excessively worn. For example, a user may be supplied with a ball striking device having a ball striking head 102 et seq. that includes a face 112 et seq. having a ball striking surface 110 et seq. located at a front of the head 102 et seq., a body 108 et seq. connected to the face 112 et seq. and extending rearward from the face 112 et seq., and an indicator 140 et seq. located on the ball striking surface 110 et seq. The indicator 140 et seq. may include at least one indent 142 et seq. in the ball striking surface 110 et seq., as described above. The ball striking device is received from the user after a period of use by the user, and the indicator 140 et seq. is examined to determine whether the indicator 140 et seq. indicates that the face 112 et seq. may be excessively worn and/or the device may be suitable for replacement, such as where wearing during use has caused sufficient material to wear away from the ball striking surface 110 et seq. such that the depth of the indent 142 et seq. has been reached and the indicator 140 et seq. is no longer visible. If the indicator 140 et seq. is no longer visible, the user is supplied with a new ball striking device to replace the ball striking device if the indicator is no longer visible. It is understood that replacement of the ball striking device is broadly defined, and may include sale of another ball striking device, complementary replacement, warranty replacement, or any other method for replacement. Where the ball striking device is a golf club and is supplied to the user as a part of a set of golf clubs, the new ball striking device may replace the original device in the set of golf clubs. The indicator 140 et seq. also can be used for testing purposes, in addition to or instead of on commercially-provided products. For example, a commercial head 102 et seq. can be provided with an indicator 140 et seq. as described above and having a desired depth, and the head 102 et seq. can be tested to determine how many strokes are necessary to cause wearing of the indicator 140 et seq. Recommendations and conclusions can then be made regarding the effective lifetime of the commercial head 102 et seq. The testing may be done under specific conditions as well, such as hitting out of sand, rough, etc., to provide information about wearing under such conditions.

The ball striking devices and heads therefor as described herein provide many benefits and advantages over existing products. For example, the indicators in iron-type heads, hybrid heads, and/or fairway wood heads as described herein may provide a visual indication to a user when the face has worn such that the face grooves are dulled and can no longer impart satisfactory spin to the ball upon contract. Accordingly, the user is able to ensure that clubs containing these features are always in best working condition, which can be particularly important for professional tour players. As another example, the indicators in wood-type heads as described herein may provide a visual indication to a user when the face has worn such that the risk of rupture is significant upon impact. Accordingly, the user is enabled to reduce the risk of a club face rupturing during play and rendering an important club unusable.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A head for a ball striking device, comprising:

a face having a ball striking surface located at a front of the head, the face having a plurality of parallel face grooves extending laterally across at least a portion of the ball striking surface;

an indicator created on the ball striking surface of the face using a manufacturing technique, located in an area between the face grooves and proximate a lateral center of the ball striking surface, the indicator comprising an indent in the ball striking surface, wherein the indent has a depth that is up to 180 μ-inches, and wherein the depth of the indicator is dimensioned relative to an edge radius of one of the face grooves, such that the indicator is configured to indicate a degree of wear on the ball striking surface when the wear on the ball striking surface reaches the depth of the indicator and causes visual disappearance of the indicator, wherein the indicator comprises a plurality of indents in the ball striking surface, each indent having a depth that is substantially less than a depth of any of the face grooves, and wherein the plurality of indents are arranged along a straight line and are all located between a first face groove and a second face groove of the plurality of face grooves.

2. The head of claim 1, wherein the depth of the indent is up to 100 μ-inches.

3. The head of claim 1, wherein the depth of the indent is less than 2% of the depth of a deepest of the face grooves.

4. The head of claim 1, wherein the depth of the indent is less than 1% of the depth of a deepest of the face grooves.

5. The head of claim 1, wherein each of the indents is circular in shape.

6. The head of claim 1, wherein the indent is created by laser etching on the ball striking surface.

7. The head of claim 1, wherein the manufacturing technique is selected from a group consisting of: a laser etching technique, a machining or milling technique, a stamping technique, and a chemical etching technique.

8. An iron-type golf club comprising:

a golf club head comprising:

a face having a ball striking surface located at a front of the head, the face having a plurality of parallel face grooves extending laterally across at least a portion of the ball striking surface;

a body connected to the face and extending rearward from the face; and an indicator created on the ball striking surface of the face using a manufacturing technique, located in an area between the face grooves and proximate a lateral center of the ball striking surface, the indicator comprising an indent in the ball striking surface, wherein the indent has a depth that is up to 180 μ-inches, and wherein the depth of the indicator is dimensioned relative to an edge radius of one of the face grooves, such that the indicator is configured to indicate a degree of wear on the ball striking surface when the wear on the ball striking surface reaches the depth of the indicator and causes visual disappearance of the indicator, wherein the indicator comprises a plurality of indents in the ball surface, each indent having a depth that is substantially less than a depth of any of the face grooves, and wherein the plurality of indents are arranged along a straight line and are all located between a first face groove and a second face groove of the plurality of face grooves; and a shaft connected to the head.

9. An iron-type golf club head comprising:

a face having a ball striking surface located at a front of the head, the face having a plurality of parallel face grooves extending laterally across at least a portion of the ball striking surface;

a body connected to the face and extending rearward from the face; and an indicator created on the ball striking surface of the face using a manufacturing technique, located below a lowermost face groove, proximate a lateral center of the ball striking surface, and proximate a lower edge of the face, the indicator comprising an indent in the ball striking surface, wherein the indent has a depth that is up to 180 μ-inches, and wherein the depth of the indicator is dimensioned relative to an edge radius of one of the face grooves, such that the indicator is configured to indicate a degree of wear on the ball striking surface when the wear on the ball striking surface reaches the depth of the indicator and causes visual disappearance of the indicator, wherein the indent is located on a curved portion of the head, at a juncture between the face and the body proximate the lower edge of the face.

10. The iron-type golf club head of claim 9, wherein the depth of the indent is up to 100 μ-inches.

11. The iron-type golf club head of claim 9, wherein the depth of the indent is less than 2% of the depth of a deepest of the face grooves.

12. The iron-type golf club head of claim 9, wherein the depth of the indent is less than 1% of the depth of a deepest of the face grooves.

13. The iron-type golf club head of claim 9, wherein the indent is created by laser etching on the ball striking surface.

14. The iron-type golf club head of claim 9, wherein the manufacturing technique is selected from a group consisting of: a laser etching technique, a machining or milling technique, a stamping technique, and a chemical etching technique.

15. An iron-type golf club comprising an iron-type golf club head comprising:

a face having a ball striking surface located at a front of the head, the face having a plurality of parallel face grooves extending laterally across at least a portion of the ball striking surface;

a body connected to the face and extending rearward from the face; and an indicator created on the ball striking surface of the face using a manufacturing technique, located below a lowermost face groove, proximate a lateral center of the ball striking surface, and proximate a lower edge of the face, the indicator comprising an indent in the ball striking surface, wherein the indent has a depth that is up to 180 μ-inches, and wherein the depth of the indicator is dimensioned relative to an edge radius of one of the face grooves, such that the indicator is configured to indicate a degree of wear on the ball striking surface when the wear on the ball striking surface reaches the depth of the indicator and causes visual disappearance of the indicator, wherein the indent is located on a curved portion of the head, at a juncture between the face and the body proximate the lower edge of the face; and a shaft connected to the iron-type golf club head.

16. A head for a ball striking device, comprising:

a face having a ball striking surface located at a front of the head, the face having a plurality of parallel face grooves extending laterally across at least a portion of the ball striking surface;

an indicator created on the ball striking surface of the face using a manufacturing technique, located in an area between the face grooves and proximate a lateral center of the ball striking surface, the indicator comprising an indent in the ball striking surface, wherein the indent has a depth that is up to 180 μ-inches, and wherein the depth of the indicator is dimensioned relative to an edge radius of one of the face grooves, such that the indicator is configured to indicate a degree of wear on the ball striking surface when the wear on the ball striking surface reaches the depth of the indicator and causes visual disappearance of the indicator, wherein the indicator comprises a plurality of indents in the ball striking surface, each indent having a depth that is substantially less than a depth of any of the face grooves, and wherein each of the indents is circular in shape.

* * * * *